US006941954B1

(12) United States Patent
Belcher

(10) Patent No.: US 6,941,954 B1
(45) Date of Patent: Sep. 13, 2005

(54) FINGERNAIL PROTECTION DEVICE

(76) Inventor: Michele Belcher, 117 Greenwood Dr., Freehold, NJ (US) 07728

( * ) Notice: Subject to any disclaimer, the term of this patent is extended or adjusted under 35 U.S.C. 154(b) by 98 days.

(21) Appl. No.: 10/368,795

(22) Filed: Feb. 20, 2003

(51) Int. Cl.[7] ..... A45D 29/00; A45D 29/18
(52) U.S. Cl. ..... 132/73; 132/73.5
(58) Field of Search ..... 132/73, 285, 73.5; 2/163, 167, 161.3, 159, 161.1

(56) References Cited

U.S. PATENT DOCUMENTS 2,633,139 A * 3/1953 Pettey ..... 132/73
2,688,331 A * 9/1954 Bogoslowsky ..... 132/73
3,598,685 A * 8/1971 Lee et al. ..... 132/73
3,972,325 A * 8/1976 Bluestone ..... 128/846
3,993,084 A 11/1976 Cullen
4,960,138 A 10/1990 Kling
5,121,760 A 6/1992 Ward
5,879,771 A * 3/1999 Kypreos ..... 428/64.1
6,536,444 B1 * 3/2003 Chung ..... 132/200
6,662,807 B2 * 12/2003 Meinschewnk ..... 132/200

* cited by examiner

*Primary Examiner*—John J. Wilson
*Assistant Examiner*—Robyn Doan

(57) ABSTRACT

A fingernail protection device for preventing ultra-violet radiation from yellowing nail polish in a tanning bed includes a plurality of tabs. Each of the tabs is flexible and includes a plurality of adjacently positioned layers. A first layer of the plurality of layers comprises a ultra-violet radiation impermeable material. The first layer has a first side and a second side. A second layer of the plurality of layers comprises an adhesive positioned on the first layer. Each of the tabs may be removably attached to a fingernail such that the fingernail is substantially covered and protected from ultra-violet radiation.

5 Claims, 1 Drawing Sheet

FINGERNAIL PROTECTION DEVICE

BACKGROUND OF THE INVENTION

1. Field of the Invention

The present invention relates to fingernail protectors and more particularly pertains to a new fingernail protector for preventing ultra-violet radiation from yellowing nail polish in a tanning bed.

2. Description of the Prior Art

The use of fingernail protectors is known in the prior art. U.S. Pat. No. 5,121,760 describes a device for protecting the free edge of a fingernail. Another type of fingernail protector is U.S. Pat. No. 3,993,084 for wrapping a fingernail so that it may grow to a desired length. U.S. Pat. No. 4,960,138 describes a protector for preventing damage to a fingernail.

While these devices fulfill their respective, particular objectives and requirements, the need remains for a device which will protect the fingernail polish on a finger nail from yellowing due to exposure from high intensity ultra-violet radiation which is found in tanning bed devices.

SUMMARY OF THE INVENTION

The present invention meets the needs presented above by providing a tab with a ultra-violet impermeable layer which is removably positionable on a fingernail as needed.

To this end, the present invention generally comprises a plurality of tabs. Each of the tabs is flexible and includes a plurality of adjacently positioned layers. A first layer of the plurality of layers comprises a ultra-violet radiation impermeable material. The first layer has a first side and a second side. A second layer of the plurality of layers comprises an adhesive positioned on the first layer. Each of the tabs may be removably attached to a fingernail such that the fingernail is substantially covered and protected from ultra-violet radiation.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
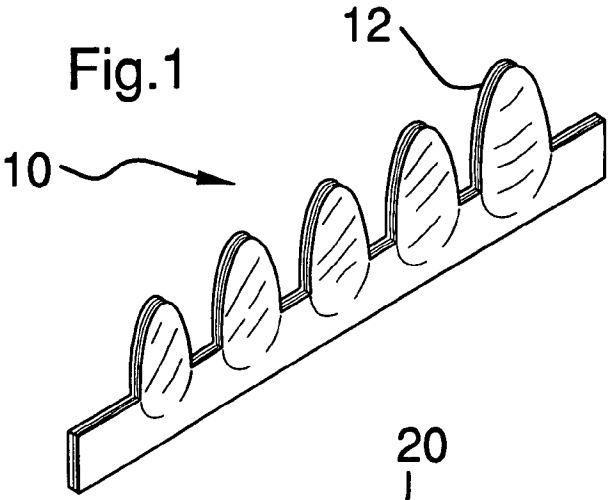
FIG. 1 is a schematic perspective view of a fingernail protection device according to the present invention.

With reference now to the drawings, and in particular to FIGS. 1 through 4 thereof, a new fingernail protector embodying the principles and concepts of the present invention and generally designated by the reference numeral 10 will be described.

As best illustrated in FIGS. 1 through 4, the fingernail protection device 10 generally comprises a plurality of tabs 12. Each of the tabs 12 is flexible and includes a plurality of adjacently positioned layers. A first layer 14 of the plurality of layers comprises a ultra-violet (UV) radiation impermeable material. This may be a clear plastic having UV absorbing materials therein or an opaque material which prevents all light from passing through the first layer. The first layer 14 has a first side 16 and a second side 18. A second layer 20 of the plurality of layers comprises an adhesive positioned on and generally coats the first side 16 of the first layer 14. The adhesive, or second layer 20, is preferably a pressure sensitive adhesive adapted for attaching the tab to a fingernail and allowing the tab to be removed without damage to the fingernail or fingernail polish coating the fingernail. A third layer 22 of the plurality of layers comprises a removable covering removably positioned on the adhesive such that the adhesive 20 is disposed between the first 14 and third 22 layers. Each of the tabs 12 has a different size and each of the tabs has a shape adapted for covering a fingernail. The different sizes allow the tabs 12 to fit on different sized fingernails.

Figure 2:
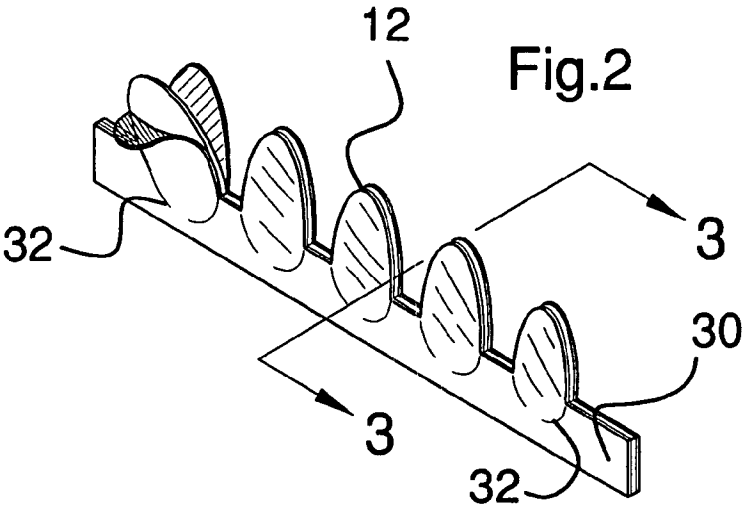
FIG. 2 is a schematic perspective view of the present invention.
Figure 3:
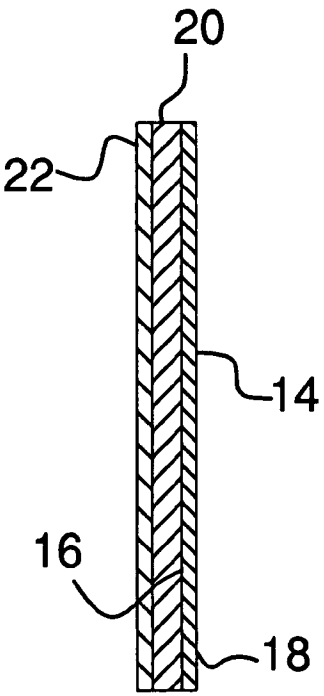
FIG. 3 is a schematic cross-sectional view taken along line 3—3 of the present invention.
Figure 4:
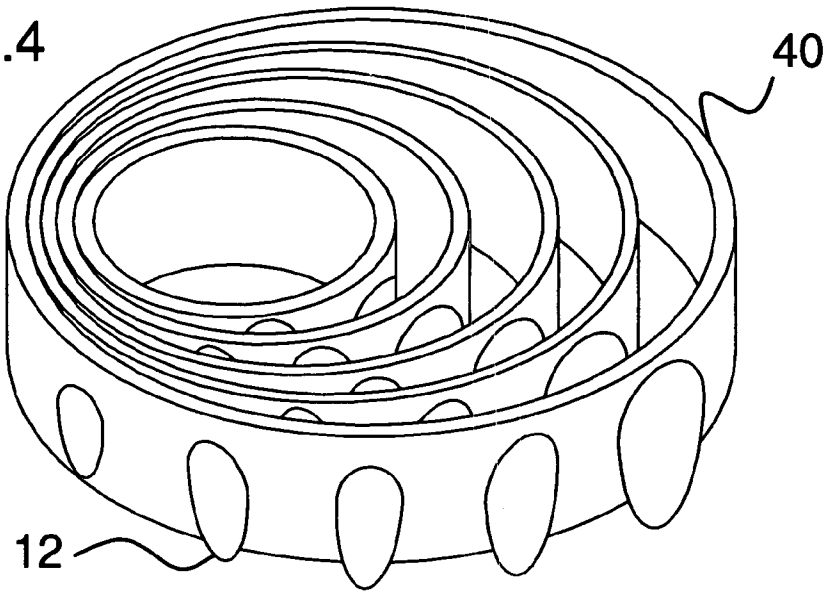
FIG. 4 is a schematic perspective view of an alternate embodiment of the present invention.

Preferably, each of the tabs 12 is integrally attached to and extends away from a strip 30 as depicted in FIGS. 1 and 2. Ideally, a juncture 32 of each of the tabs 12 and the strip 30 is perforated such that the tabs 12 may be selectively removed from the strip 30. In such an embodiment, it is preferred that the strip 30 be constructed of the same materials and layers as the tabs 12. Alternatively, the tabs 12 may be attached to a panel 40 by the adhesive 20 as depicted in FIG. 4. In this embodiment, the panel 40 serves the same function as the third layer 22.

In use, the adhesive 20 is used to removably attach each of the tabs 12 to a fingernail such that the fingernail is substantially covered. The tabs 12 prevent ultra-violet radiation from reaching the nail polish on the fingernail so that the nail polish is not yellowed from exposure to such radiation found within a tanning booth or tanning bed.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fingernail protective covering system comprising:

an elongated strip;

a plurality of tabs, each of said tabs being flexible, each of said tabs including a plurality of adjacently positioned layers, a first layer of said plurality of layers comprising an ultra-violet radiation impermeable material, said first layer having a first side and a second side, a second layer of said plurality of layers comprising an adhesive positioned on and generally coating said first side of said first layer, each of said tabs being integrally attached to and extending away from said strip, said tabs being spaced from each other, a juncture of each of said tabs and said strip being perforated such that said tabs may be selectively removed from said strip; and wherein each of said tabs may be removably attached to a fingernail such that the fingernail is substantially covered and protected from ultra-violet radiation.

2. The fingernail protective covering system of claim 1, further including a third layer of said plurality of layers comprising a removable covering removably positioned on said adhesive such that said adhesive is disposed between said first and third layers.

3. The fingernail protective covering system of claim 1, wherein each of said tabs has a different size.

4. The fingernail protective covering system of claim 1, wherein each of said tabs has a shape adapted for covering a fingernail.

5. A fingernail protective covering system comprising:

an elongated strip;

a plurality of tabs, each of said tabs being flexible, each of said tabs including a plurality of adjacently positioned layers, a first layer of said plurality of layers comprising an ultra-violet radiation impermeable material, said first layer having a first side and a second side, a second layer of said plurality of layers comprising an adhesive positioned on and generally coating said first side of said first layer, a third layer of said plurality of layers comprising a removable covering removably positioned on said adhesive such that said adhesive is disposed between said first and third layers, each of said tabs having a different size, each of said tabs having a shape adapted for covering a fingernail, each of said tabs being integrally attached to and extending away from said strip, said tabs being spaced from each other, a juncture of each of said tabs and said strip being perforated such that said tabs may be selectively removed from said strip; and wherein each of said tabs may be removably attached to a fingernail such that the fingernail is substantially covered and protected from ultra-violet radiation.

* * * * *